US005979655A

United States Patent [19]

Tseng et al.

[11] Patent Number: 5,979,655

[45] Date of Patent: Nov. 9, 1999

[54] PLASTIC BAG STACK WITH SPECIAL TAB OPENING

[75] Inventors: Ben Tseng, East Brunswick; Ron C. Yeh, Morganville, both of N.J.; Ernest Acosta, Victoria; Yook-Meng Chew, Port Lavaca, both of Tex.

[73] Assignee: Inteplast Group, Ltd., Livingston, N.J.

[21] Appl. No.: 09/089,982

[22] Filed: Jun. 3, 1998

[51] Int. Cl.[6] ..... B65D 33/10

[52] U.S. Cl. ..... 206/554; 383/8; 383/9

[58] Field of Search ..... 383/8, 9; 205/554

[56] References Cited

U.S. PATENT DOCUMENTS 5,188,235 2/1993 Pierce et al. ..... 206/554
5,269,605 12/1993 Nguyen ..... 383/9
5,346,310 9/1994 Nguyen ..... 383/9
5,562,580 10/1996 Beasley et al. ..... 206/554

*Primary Examiner*—Stephen P. Garbe
*Attorney, Agent, or Firm*—William H. Pavitt, Jr.; David A. Belasco; Mario A. Martella

[57] ABSTRACT

A pack of registering plastic T-shirt bags in which the walls of each bag are provided with registering central tabs projecting into the bag mouth, the tabs each having a rack retainer mounting orifice comprising a lower transverse cut portion extending between points spaced inwardly from the side edges of the tab with one end of the cut portion curving back and upwardly to extend toward, but terminating before reaching, the upper edge of the tab; and the other end of the cut portion also curving back upwardly and terminating in a segment of the cut extending back parallel to the lower transverse portion for a distance less than half the extent of said latter portion; thereby, the tabs of the bags may be mounted on a rack retainer by passing the retainer through the lower transverse cut portion of the mounting orifice.

5 Claims, 1 Drawing Sheet

PLASTIC BAG STACK WITH SPECIAL TAB OPENING

FIELD OF THE INVENTION

This invention relates to the field of plastic shopping bags and, particularly, to those shopping bags which are called T-shirt bags and other bags which are provided in stacks to be mounted on, and supported by, a rack, one element of which is a central upwardly extending retainer.

DESCRIPTION OF THE PRIOR ART

It has been a long established practice to mount T-shirt bags by means of tabs projecting upwardly from the lower area of the bag mouth. An early example of such a bag may be found in U.S. Pat. No. 4,165,832 which issued on Aug. 28, 1979 to Mobil Oil Corporation, as assignee of the inventors. FIG. 4 of this patent is illustrative of an early bag design for mounting on a centrally disposed rack retainer. Subsequently issued patents, namely U.S. Pat. Nos. 4,529,090 and RE Pat. No. 33,264 also show the use of a central tab to support at least the central areas of bags disposed on dispensing racks.

It will be observed, however, that in these prior art bag constructions, the central mounting tabs are orificed below their upper edges to enable the tab to be slipped over the central retainer element in a rack such as that shown in Reissue Pat. No. 33,264. There is further provided, however, a second cut or at least perforated area below the mounting slot, the purpose of which second cut or perforation being to enable the central mounting tab to be detached from the upper edges of the bag walls at the time the bag has been filled and is being removed from the rack. This detachment is further made possible by the fact that the tabs of all of the bags in the bag stack are secured together in register by having been subjected to a hot pin passed through all of the tabs at the time rectangular bag blanks, in well known manufacturing processes, are being cut to shape, and slotted, perforated or cut by a die which is brought down on the bag stack to produce a stack of bags which can be mounted on the central retainer of a now conventional rack.

A principal problem with this type of bag stack is that the detachable tabs, being adhered together, remain on the retainer as a plug after their respective bags have been detached from them. Before the next stack of bags may be mounted on the rack, it is necessary to remove this plug and in some manner dispose of it. This not only impedes the work of the person at the checkout counter, but produces waste material which must be disposed of in some environmentally acceptable manner. While attempts to obviate this problem have been made in U.S. Pat. Nos. 5,269,605 and 5,346,310 by providing in the tab a single cut of a special configuration, when an effort is made to use such cut for mounting purposes and to allow for rupturing the slot upon removal of the bag, as taught in U.S. Pat. Nos. 5,269,605 and 5,346,310, it will be found that the breakout may actually occur at the time the rack retainer is pushed through the mounting slots of the bags in the bag pack. This results in the centers of the bags being improperly supported during the opening and filling of the bags.

SUMMARY OF THE INVENTION

The present invention effectively eliminates the necessity of dealing with detachable mounting tabs by providing a special orificed projection (or tab) which extends upwardly for a short distance from the level of the bottom of the bag mouth. This projection may be provided with an opening of a special shape, namely one defined by a cut, the lower part of which may be a transverse line terminating at its ends in upwardly and backwardly extending curves. One curve continues at its top and as a partial upper line parallel to the transverse lower line for a portion of the distance of the lower line. The other curve terminates in a similar parallel line, but then continues as a concave curve extending upwardly itself to terminate below the upper edge of the projection (or tab) to provide a readily severable area. This type of cut enables the projection or tab to be slipped over the rack retainer, but whenever the bag is pulled, as when the bag is being filled with articles, or is pulled off the rack, the area of the tab between the upper end of the concave curve and the upper edge of the tab will sever, so that the tab will be removed with the bag of which it is a part. The cut configuration also prevents the opening defined by the cut from being extended downwardly into the bag walls. Any tendency, therefore, on the part of the cut to be expanded upon the insertion of the retainer element into the opening which the cut defines simply results in the tear being directed back upwardly and inwardly of the tab.

It is also a feature of the present invention to eliminate the use of a hot pin passed through adjacent the mounting tabs when the bag stack is die cut. This is accomplished by corona-treating the outsides of the bag walls in the manner taught by my co-pending application Ser. No. 09/050,708, filed Mar. 30, 1998, in conjunction with a pair of pressure points on each corner of the projection or tab. These pressure points, in conjunction with effective corona-treatment of the outside walls of the bags will produce the desired detachable adherence of the projections of adjacent bags to maintain the tabs in register for mounting on a rack retainer.

DESCRIPTION OF THE DRAWINGS

In the accompanying drawings.

DESCRIPTION OF THE PREFERRED EMBODIMENT

Figure 1:
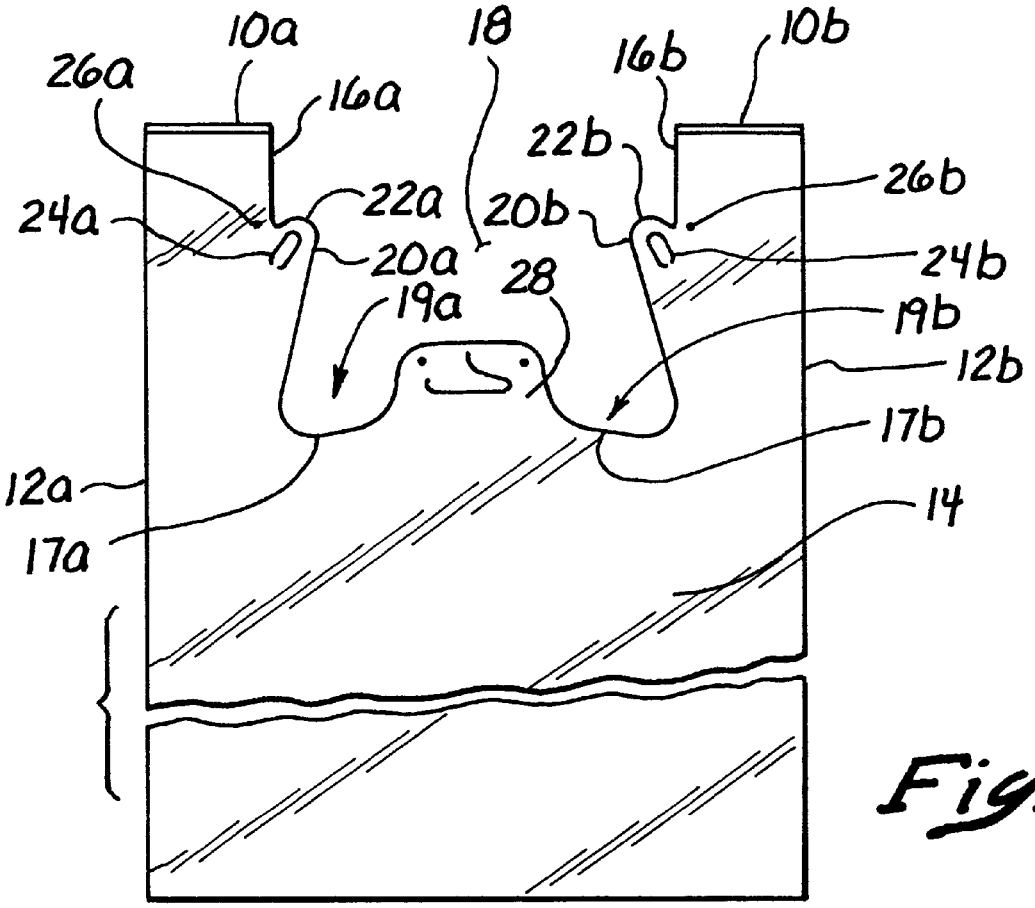
FIG. 1 is a plan view of the present invention.

Referring to the plan view of the T-shirt bag of the present invention illustrated in FIG. 1, a pair of handles 10*a*, 10*b*, extend upwardly from both sides 12*a*, 12*b* of a bag 14 formed from a continuous length of plastic tubing in the manner well known in the art and illustrated in co-pending application Ser. No. 09/050,708, filed Mar. 30, 1998.

The configuration of the handles differs somewhat from the prior art in that the inside edges 16*a*, 16*b* which, with the upper edges 17*a*, 17*b* of the central cutout portions 19*a*, 19*b*, and tab 28, define the bag mouth are curved at 20*a*, 20*b*, to form a pair of inwardly extending ears 22*a*, 22*b*, within which are provided inverted U-shaped rack rod mounting cuts, 24*a*, 24*b*. In order to keep cuts 24*a*, 24*b* of adjacent bags of a pack stack in register, pin pressure points 26*a*, 26*b* may be provided at the time blanks are cut by dies to form a stack of bags, each in the configuration of FIG. 1. These pressure points 26*a*, 26*b*, in conjunction with corona treatment of the outside of the walls of the bags which form the stack in the manner taught in the aforesaid co-pending application will be found to be effective in keeping the cuts 24*a*, 24*b* of adjacent bags in register, as well as in causing each bag to open as the bag preceding it on the rack is pulled off the rack.

Figure 2:
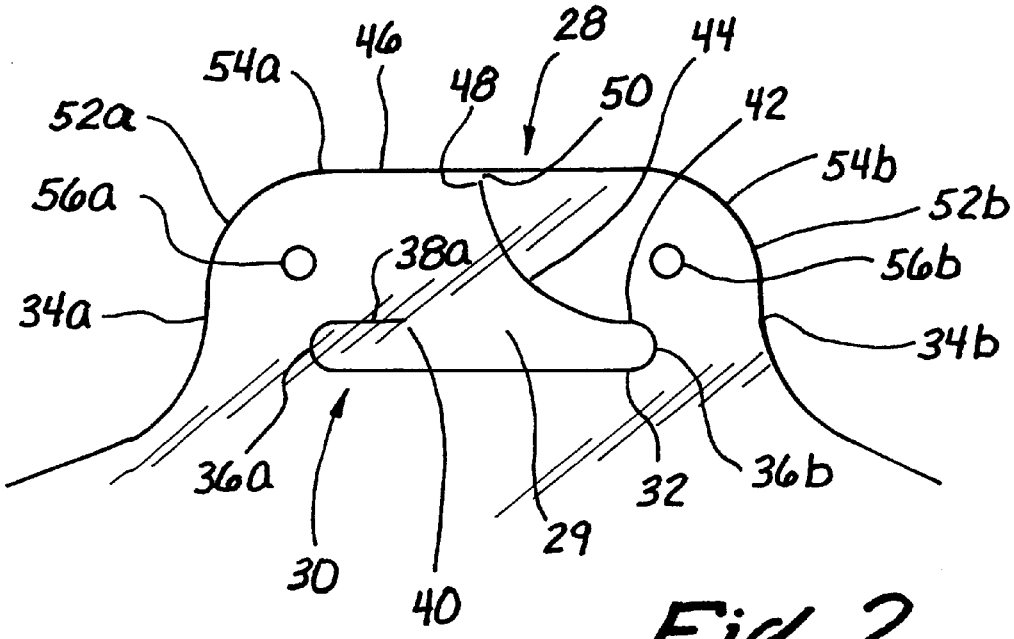
FIG. 2 is an enlarged corner upwardly projecting portion (or tab) of the bag shown in FIG. 1.

FIG. 2 of the drawings is an enlarged view of the projection or tab 28 of each of the bag walls centrally disposed in the bag illustrated in FIG. 1. In order to mount the tab 28 on the central retainer of the conventional rack, a slot or opening 29 may be provided by means of a cut 30 of special configuration. This cut comprises a transverse base line 32 which extends part way between the side edges 34*a*, 34*b* of the projection or tab 28, and terminates at each end in an upwardly and backwardly extending curve 36*a*, 36*b*, respectively. As may be seen from the drawing, as curve 36*a* completes a 180 degree turn, it extends for a brief distance as a transverse segment 38*a*, which is parallel to the cut line 32. The segment 38*a* terminates at 40 after it has only paralleled the lower cut line 32 for a short distance.

Curve 36*b* at the opposite end of the cut line 32 initially is a reverse counterpart of curve 36*a*, but upon completing 180 degrees, it extends only as a very short segment 42 parallel to the cut line 32, then immediately continues as a reverse curve 44 upwardly toward the upper edge 46 of the projection or tab 28. Curve 44, however, terminates at 48 before reaching the upper edge 46 of the projection or tab 28, thereby leaving a small tear space 50 between the curve terminus 48 and said upper edge 46.

It is also a feature of the bag of the present invention that each of the comers 52*a*, 52*b* of the upper portion of the tab 28 is configured with curved segments 54*a*, 54*b*, respectively, which bridge the horizontal upper edge 46 and the vertical side edges 34*a*, 34*b*, respectively over a 90 degree are. Lastly, inwardly of the corners 52*a* and 52*b*, respectively, are provided pin pressure points 56*a*, 56*b*, the purpose of which is to keep the openings 29 of adjacent bags in register so that the projections or tabs 28 may be mounted on the central retainer of the conventional rack (not shown). From the foregoing description, it may be seen that there is provided a tab opening 29 which will not propagate any tear down into the bag walls below the tab 28. Moreover, the tab 28 will quickly be released from the rack retainer (not shown) upon a minimum of pulling since the tear space 50 between the terminus 48 of the curve 44 and the upper edge 46 of the tab 28 is very small, with the result that any force applied at the opening 29 of the tab 28 will rupture the area 50, thereby permitting removal of the tab from the rack retainer element (not shown) with the remainder of the bag.

We claim:

1. A stack of T-shirt bags for dispensing, from a rack having a pair of forwardly extending arms spaced from each other and an upwardly extending retainer element disposed equidistantly between the rack arms, each bag of the stack being formed of a front wall and a back wall, said walls being secured to each other along at least a portion of their side edges said walls being centrally cut out from their upper edges and inward of their side edges for a predetermined distance to form a bag mouth bordered on its sides by a pair of handles unitary with the remainder of the bag walls, and said bag mouth further being defined by transverse wall edges extending between the handles at the innermost cutout portions of the walls; and central registering mounting tabs projecting upwardly from said transverse edges into the bag mouth, said tabs each having a pair of side edges and an upper transverse edge, each said tab further having a centrally disposed cut, said cut including a transverse base segment having first and second upwardly turned end segments, the first segment terminating along line parallel to the transverse base segment but spaced from the second upwardly curved segment; and the latter segment being continued in a reversed upward curve extending toward but terminating at a point spaced from the upper edge of the tab to leave therebetween a readily severable area;

whereby there is defined a sufficient portion of an opening in the tab to mount the tab on the rack retainer element, but when the tab is pulled against the rack retainer element, the readily severable area is ruptured to detach the tab from the rack retainer element for removal from the rack with the bag wall from which the tab projects.

2. A stack of plastic T-shirt bags as described in claim 1 wherein each mounting tab has a pair of upper corners, each corner being defined by an edge portion which comprises a segment which extends at a 45 degree angle to the upper and side edges of the tab.

3. A stack of plastic T-shirt bags as described in claim 1 wherein the outside walls of each bag have been corona treated and inwardly of each upper side edge of the tab, the tab has been subjected to pin pressure, whereby the tabs of the bag stack are maintained in register for placement over the retainer elements.

4. A stack of plastic T-shirt bags as described in claim 3 wherein the pressure points on the tab in conjunction with the corona treatment of the outer walls of each bag of the stack will result in each bag being self-opening as its previous bag of the stack is removed from the rack.

5. A stack of plastic T-shirt bags as described in claim 1, wherein the outside of the walls of each bag have been corona treated each of the handles defining the side of the bag mouth is subjected to pin type pressure adjacent the handle orifice, thereby, in combination with the corona treatment of the outside walls of the handles, contributing to the ability of the bag to self-open when its preceding bag of the stack is removed from the rack.

* * * * *